US007532833B2

(12) United States Patent
Inoue

(10) Patent No.: US 7,532,833 B2
(45) Date of Patent: May 12, 2009

(54) PRINTING APPARATUS, PRINTING SYSTEM, AND PREDICTION METHOD OF USAGE OF PRINTING AGENT

(75) Inventor: Hirowo Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 293 days.

(21) Appl. No.: 11/008,981

(22) Filed: Dec. 13, 2004

(65) Prior Publication Data

US 2005/0128228 A1 Jun. 16, 2005

(30) Foreign Application Priority Data

Dec. 15, 2003 (JP) ..... 2003-417368

(51) Int. Cl.
*G03G 15/10* (2006.01)

(52) U.S. Cl. ..... 399/58; 399/27; 399/49; 399/61; 347/5; 347/7; 347/19; 355/112

(58) Field of Classification Search ..... 347/5, 347/7, 19; 399/27, 58, 49, 61; 358/1.9; 355/112; 400/76

See application file for complete search history.

(56) References Cited

U.S. PATENT DOCUMENTS 4,233,663 A * 11/1980 Sugawara et al. ..... 358/296
6,145,947 A * 11/2000 Inora et al. ..... 347/7
6,356,359 B1 * 3/2002 Motamed ..... 358/1.8
6,366,744 B1 * 4/2002 Phillips et al. ..... 399/24
6,516,160 B1 * 2/2003 Rodriguez ..... 399/27
6,580,879 B2 * 6/2003 Coleman et al. ..... 399/27
6,856,430 B1 * 2/2005 Gase ..... 358/1.9
6,897,968 B1 * 5/2005 Markham ..... 358/1.1
2007/0070454 A1 * 3/2007 Ernst et al. ..... 358/504

FOREIGN PATENT DOCUMENTS

JP 7-32606 2/1995
JP 2002-59569 2/2002

* cited by examiner

*Primary Examiner*—Leslie J Evanisko
*Assistant Examiner*—Matthew G Marini
(74) *Attorney, Agent, or Firm*—Fitzpatrick, Cella, Harper & Scinto

(57) ABSTRACT

A printing apparatus, a printing system, and a prediction method of the usage of a printing agent can be configured to predict, prior to a processing for developing a printing image, the usage of a printing agent required for the printing. In order to do so, layout information is firstly analyzed prior to a processing for developing a printing image, thereby calculating an area in which object information arranged based on the layout information is printed. Then, based on the calculated printing area, the usage of the printing agent required for printing the object information is predicted.

14 Claims, 13 Drawing Sheets

123
DIGITAL CAMERA, PC OR THE LIKE
124
MEMORY CARD I/F
122
DIGITAL CAMERA, PC OR THE LIKE, CONNECTION I/F
LOGIC VOLTAGE 1
LOGIC VOLTAGE 2
MOTOR VOLTAGE
HEAD VOLTAGE
116
DRIVER
5
M2
115
DRIVER
3
M1
114
DRIVER
113
M3
MPU
120
POWER SOURCE SECTION
109
SHEET SENSOR
103
RAM
112
INK JET PRINTING HEAD
111
DRIVER
102
DATA BUS
ADDRESS BUS

```
<html>
 <body>
  <table><tr><td>
   <img src="DCIM/100CANON/img0001.jpg">
  </td><td>
   <img src="DCIM/100CANON/img0001.jpg">
  </td><td>
   <img src="DCIM/100CANON/img0001.jpg">
  </td><td>
   <img src="DCIM/100CANON/img0001.jpg">
  </td></tr>
  <tr><td>
   <img src="DCIM/100CANON/img0001.jpg">
  </td><td>
   <img src="DCIM/100CANON/img0001.jpg">
  </td><td>
   <img src="DCIM/100CANON/img0001.jpg">
  </td><td>
   <img src="DCIM/100CANON/img0001.jpg">
  </td></tr>
  </table>
 <body>
</html>
```

FIG.8A

```
img{width: 300; height: 200; border: 0}
td{width: 320: height: 220; border: 10}
```

FIG.8B

PRINTING APPARATUS, PRINTING SYSTEM, AND PREDICTION METHOD OF USAGE OF PRINTING AGENT

BACKGROUND OF THE INVENTION

1. Field of the Invention

The present invention relates to a printing apparatus, a printing system, and a prediction method of the usage of a printing agent that can be configured to predict, prior to the development processing of a printing image (to-be-printed image), the usage of the printing agent (e.g., ink) required for the printing.

2. Description of the Related Art

A printing apparatus requires a printing agent (e.g., ink) in order to provide printing to a printing medium. One ink supply method is, for example, an on-demand supply method (also called as pit in method) for a serial scan type printing apparatus in which a carriage having a reciprocating movement in a main scanning direction includes an ink jet printing head. This method is a method in which, only when ink needs to be supplied to a tank included in the carriage (sub tank), ink is supplied from a tank (main tank) in a printing apparatus body to the sub tank by allowing the sub tank to communicate with the main tank.

Generally, when such an ink supply method is practically used, the sub tank has a capacity for retaining the ink amount for providing the printing (printing of solid image for one to two page(s) or more) based on full address data for one to two page(s) or more of a printing medium, for example. When the ink amount in the sub tank is reduced, ink is appropriately supplied from the main tank.

A conventional method for controlling the timing at which ink is supplied in such an ink jet printing apparatus is disclosed in Japanese Patent Application Laid-open No. 7-032606 (1995). In this method, printing data to be printed next printing is previously read to count, based on the printing data, a planned ejection number of ink droplets at the next printing, thereby calculating, based on the count value, a planned ink use amount at the next printing. Then, the planned ink use amount is compared with the amount of ink currently remaining in the sub tank. When the former amount is smaller than the latter amount, ink is supplied to the sub tank.

Japanese Patent Application Laid-open No. 2002-059569 also suggests a method in which the time required for the processing for developing image data is saved by using an easier processing to predict the ejection number of ink droplets at the next printing. In this method, the attribute information regarding image contents previously specified at the printing is referred so that the ejection number of ink droplets is predicted based on this information. The ejection number is used for determining whether ink supply is required or not.

Recently, improvement of a processing function of a printer and diversification of data formats that can be processed by a printer have gradually enabled the printing processing having a more complicated layout than that assumed by the above conventional techniques.

For example, there have been an increased number of cases in which, when a digital camera or a cell phone or the like is connected to use various image sources for printing, the printing must be performed in accordance with an arbitrary layout (e.g., index layout, seal layout, home page layout). In such a case, a single page in particular must have thereon a plurality of pieces of information for image, character, and/or graphic object information. Thus, it has been difficult to estimate the contents of the image to be printed when only the attribute information of the image is available.

In the case of a layout in which a single page has thereon such a plurality of pieces of object information, when all of these pieces of object information are developed to be previously processed so that the planned ink use amount is calculated more accurately, a factor such as the speed of a communication interface causes the significant increase of the printing time. This causes a risk in which the printing operation may be performed for such a long time that deteriorates the practicality. An increased printing resolution and an improved image quality of image source preparation machines (e.g., digital camera) in particular have allowed the size of data (e.g., image data) to increase continuously. Due to this reason, an index layout in which these images are arranged for example requires an enormous amount of time for merely reading the image data.

On the other hand, regular printing operations have a tendency where a time required for the printing for one page has been reduced continuously. Thus, the long-time processing as described above is a demerit to a user, causing the corresponding product specification to be not suitable for a practical use. The same particularly applies to a printing apparatus using an on-demand ink supply method as described above.

Specifically, in the printing apparatus using the on-demand ink supply method, the number of times at which ink is supplied from a main tank to a sub tank is increased (i.e., the number of times at which communication and blocking between these tanks are performed is increased), which causes an increase in the amount of ink consumed for operations other than the image printing. In order to suppress such ink consumption for operations other than the image printing, the sub tank needs to have an increased capacity. However, this causes a carriage driving mechanism including therein the sub tank to have a larger size and/or causes the limitation to a high-speed driving of the carriage. In order to minimize the number of times at which ink is supplied from the main tank to the sub tank to suppress the consumption of ink used for operations other than the image printing, planned ink use amount may be accurately calculated by using the processing time for a longtime. However, in this case, the long-time processing is a demerit to a user, causing the corresponding product specification to be not suitable for a practical use.

SUMMARY OF THE INVENTION

The present invention can provide a printing apparatus, a printing system, and a prediction method of the usage of a printing agent that can be configured to predict, prior to the development processing of a printing image (to-be-printed image), the usage of the printing agent required for the printing.

In the first aspect of the present invention, there is provided a printing apparatus that prints, by applying a printing agent to a printing medium, object information arranged based on layout information onto the printing medium, comprising:

calculation means for analyzing the layout information to calculate a printing area in which the object information arranged based on the layout information is printed; and prediction means for predicting, based on the printing area calculated by the calculation means, the usage of the printing agent required for printing the object information.

In the second aspect of the present invention, there is provided a printing apparatus that prints, by applying a printing agent to a printing medium, object information arranged based on layout information onto the printing medium, comprising:

calculation means for analyzing the layout information to calculate the margin area when a predetermined unit area of the printing medium is printed with the object information arranged based on the layout information; and prediction means for predicting, by referring the standard usage of the printing agent required for printing the object information on a predetermined standard printing area, the usage of the printing agent required for printing the object information based on the proportion between a standard margin area obtained by deducting the standard printing area of the object information from the unit area of the printing medium and the margin area calculated by the calculation means.

In the third aspect of the present invention, there is provided a printing system, comprising:

a printing apparatus of the first or second aspect of the present invention; and an information provision apparatus for providing the information regarding the layout information and the object information.

In the fourth aspect of the present invention, there is provided a method for predicting the usage of a printing agent in a printing apparatus that prints, by applying the printing agent to a printing medium, object information arranged based on layout information onto the printing medium, the method comprising the steps of:

calculating step of analyzing the layout information prior to a processing for developing a printing image to calculate the printing area of the object information arranged based on the layout information, and predicting step of predicting, based on the calculated printing area, the usage of the printing agent required for printing the object information.

In the fifth aspect of the present invention, there is provided a method for predicting the usage of a printing agent in a printing apparatus that prints, by applying the printing agent to a printing medium, object information arranged based on layout information onto the printing medium, the method comprising the steps of:

calculating step of analyzing the layout information prior to a processing for developing a printing image to calculate the margin area when the object information arranged based on the layout information is printed on a predetermined unit area of the printing medium, and predicting step of predicting, by referring the standard usage of the printing agent required for printing the object information on a predetermined standard printing area, the usage of the printing agent required for printing the object information based on the proportion between a standard margin area obtained by deducting the standard printing area of the object information from the unit area of the printing medium and the margin area calculated by the calculating step.

In order to predict the ink amount to be consumed, the present invention does not use the conventionally-suggested processing for previously reading printing data or for analyzing the attribute information of a print image transferred from a host apparatus but the present invention allows the layout processing situated at the upstream side of the data flow to be analyzed by a printing apparatus. Then, the layout information is analyzed to compare the predicted ink consumption amount with the actually available ink amount in a quicker and simpler manner. As a result, the increase in the printing time can be prevented while the ink supply processing can be scheduled more effectively.

For example, only the information for determining the page layout is analyzed to calculate the area of "region in which no printing is performed" (i.e., the area of a margin region or blank space). A "blank space" is an area on a printing medium where either any objects or background images are not printed. In the present invention, "margin region" and "blank space" are used as a synonym. Then, the ink amount for one page required for the full page printing of a full address (full page printing for printing a solid image) (i.e., the ink usage when the margin region is 0) is compared with the area of the margin region, thereby high-speed calculating the predicted ink consumption amount in accordance with the margin area.

Furthermore, the predicted ink consumption amount can be calculated more accurately by using a plurality of pieces of accompanying information and/or header information of the object information referred by the layout information to additionally consider the predicted ink consumption amount or the like for each piece of object information. When the object information referred by the layout information is the information for a character string or a simple graphics, then the object information itself also can be additionally analyzed to predict the ink consumption amount more accurately.

Such an accurate prediction of an ink consumption amount is possible by a printing apparatus having a processing section for establishing and analyzing the layout information. It is also possible to predict, based on the layout information, the maximum ink use amount (the maximum ink consumption amount) for the same layout. The predicted maximum ink consumption amount has a value that is significantly different from that of the ink consumption amount when the full page printing for one page and a full address is performed.

In an apparatus in which the layout information can be stored in the printing apparatus and the accompanying information of the layout information can be freely specified, the layout information can be previously printed with the information regarding the area to be printed or the information regarding the margin in which no printing is performed as well as the predicted maximum ink consumption amount unique to the layout that is introduced from these pieces of information. As a result, the schedule for controlling the ink supply can be provided in a simpler manner.

According to the present invention, the layout information is analyzed prior to the development processing of the printing image (to-be-printed image), thereby calculating the printing area of the object information provided based on the layout information or the margin area when the object information is printed. Then, based on the calculated area, the usage of the printing agent required for printing the object information can be predicted, thereby predicting, prior to the development processing of the to-be-printed image, the usage of the printing agent required for the printing.

The above and other objects, effects, features and advantages of the present invention will become more apparent from the following description of embodiments thereof taken in conjunction with the accompanying drawings.

BRIEF DESCRIPTION OF THE DRAWINGS

FIG. 8A illustrates an example of a document structure description used in the printing apparatus of FIG. 6, and FIG. 8B illustrates an example of a style sheet used in the printing apparatus of FIG. 6;

DETAILED DESCRIPTION OF PREFERRED EMBODIMENTS

Hereinafter, embodiments of the present invention will be described with reference to the drawings.

First Embodiment

Figure 1:
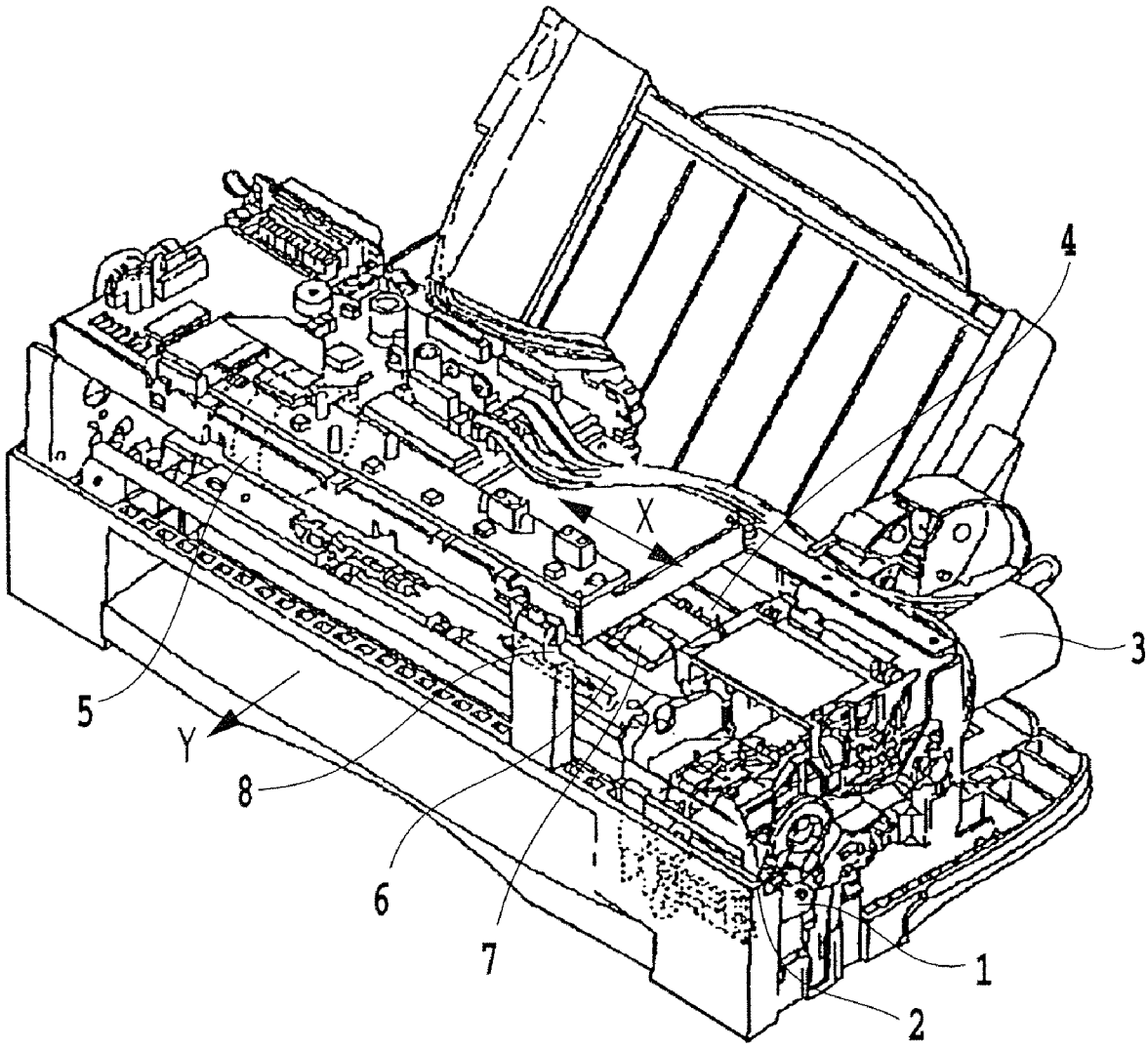
FIG. 1 is a perspective view illustrating the interior of a printing apparatus in the first embodiment of the present invention.

FIG. 1 illustrates the configuration of hardware in the printing apparatus of the first embodiment of the present invention. The printing apparatus of this example is a so-called serial scan-type ink jet printing apparatus. In this printing apparatus, an image is printed by allowing a printing head to have a printing scanning operation in the main scanning direction of arrow X that intersects with (or is orthogonal to in this example) the direction of arrow Y along which the printing medium is fed (sub scanning direction).

Next, the outline of the printing operation will be described.

First, a paper feeding roller 6 is driven by a paper feeding motor 5 via a gear to transport a printing medium to a printing position. Then, a carriage motor 3 is used to move a carriage unit 2 via a carriage belt 4 in the main scanning direction while ink is being ejected, based on to-be-printed data, from a ink jet printing head of the carriage unit 2, thereby printing an image having a fixed bandwidth. Thereafter, a predetermined amount of the printing medium is transported in the sub scanning direction. The printing of the fixed bandwidth and the transportation of the predetermined amount of the printing medium as described above are repeated to print the image on all printing regions on the printing medium. The carriage unit 2 is structured such that the carriage having a reciprocating movement in the main scanning direction is detachably attached with the ink jet printing head for ejecting ink and a tank (sub tank) for supplying ink thereto. Reference numeral 7 denotes a pressurization roller and reference numeral 8 denotes an ink jet roller. Reference numeral 1 denotes a purge unit for removing foreign material from the printing head or the ink supply system.

With regards to the printing head, an electrothermal converter (heater) or a piezo element can be used to use various ejecting methods for ejecting ink. When the electrothermal converter is used, the thermal energy can be used to foam the ink, thereby ejecting, by the foaming energy, the ink from the ink ejecting port.

When such a serial scan method is used for the printing, one path printing in which the image of a predetermined printing region is completed by one scanning by the printing head and multi-path printing in which the image of a predetermined printing region is completed by a plurality of scannings by a printing head can be used. When the multi-path printing is used, data thinned by using a predetermined mask is printed for every scanning. When the "n" path(s) printing is used, a transporting amount of the printing medium is about 1/n band.

Figures 2, 2A, 2B:
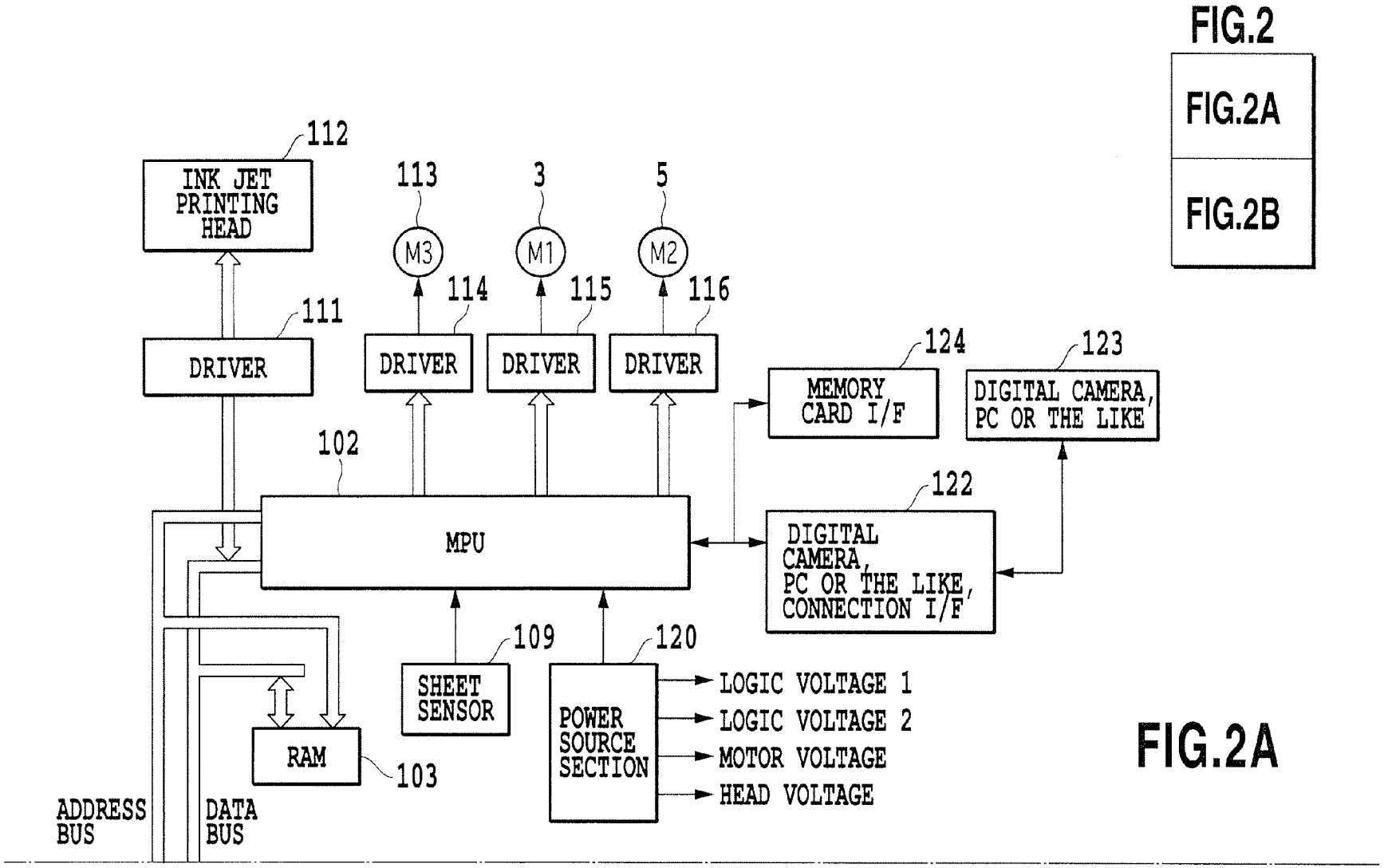
FIG. 2 is a diagram showing a relation between FIGS. 2A and 2B, and FIGS. 2A and 2B are block diagrams illustrating the control system of the printing apparatus of FIG. 1.
Figure 2B:
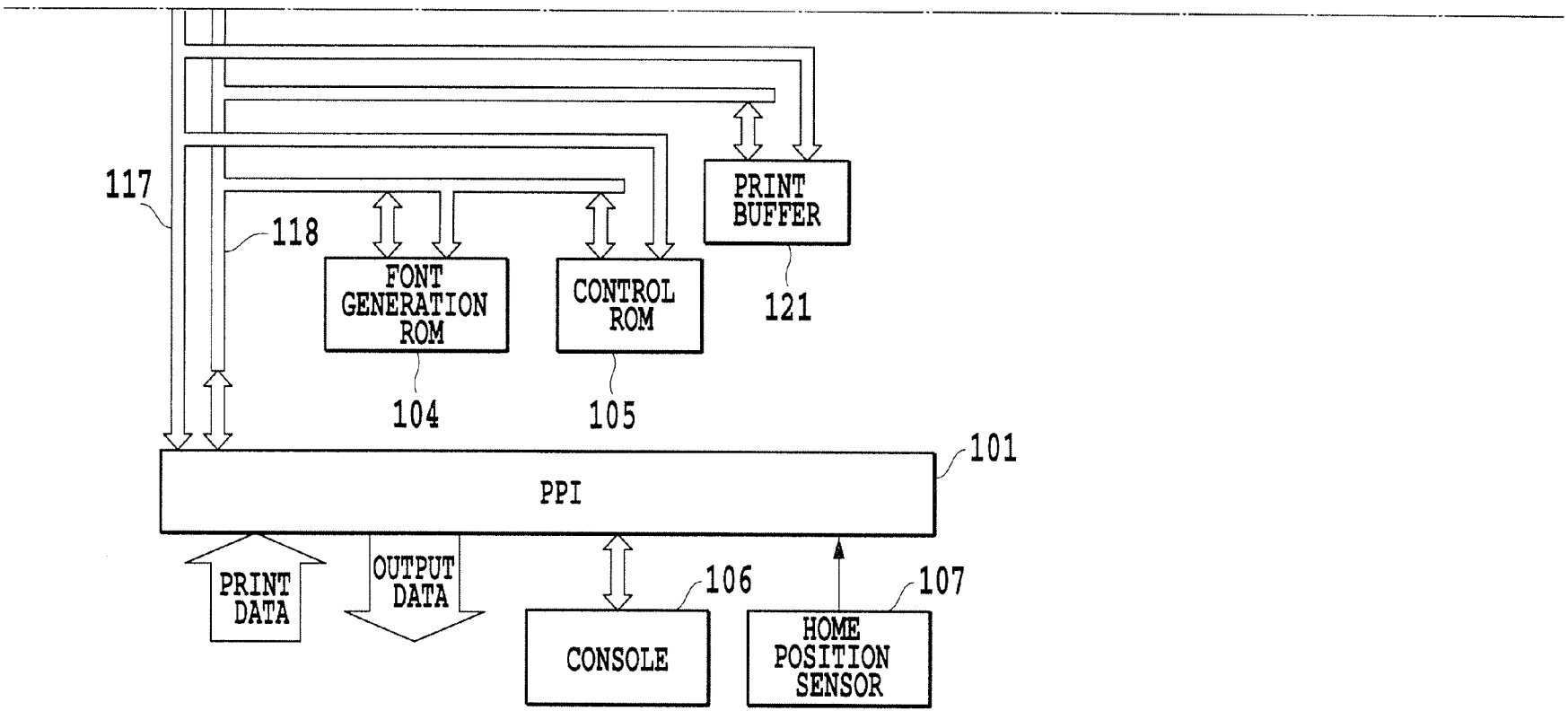

FIGS. 2A and 2B are a block diagram of the control system in the printing apparatus of this example.

In FIG. 2A, reference numeral 122 denotes a communication interface with an external device. The interface 122 has communication with an external device (also called as "host apparatus") 123 (e.g., digital camera, PC host) to perform the transmission/reception of data (e.g., data for image). A micro processing unit (MPU) 102 performs, via this interface 122, the control of devices, the reception of object information mainly referred at the printing, the control of a console 106, and the input of a signal from a home position sensor 107 that detects that the carriage is at a home position. The home position can be used as a waiting position of the carriage unit 2 and a position where a recovery processing for maintaining the ink eject status by the printing head is performed. The MPU 102 controls respective parts in this ink jet printing apparatus in accordance with the control program stored in a control ROM 105.

Reference numeral 103 denotes a RAM for temporarily storing various kinds of data. The RAM 103 is used to store received signals and or is used as a work area of the MPU 102. Reference numeral 104 denotes a font generation ROM that stores pattern information (e.g., character, picture image) corresponding to code information and that outputs various pieces of pattern information in accordance with the inputted code information. Reference numeral 121 denotes a print buffer memory for storing data developed by the ROM 104 or the like and that has a printing capacity for to-be-printed data of "m" line(s). Reference numeral 105 denotes a control ROM as described above that stores therein the processing procedure performed by the MPU 102. Each of these components is controlled by the MPU 102 via a address bus 117 and a data bus 118.

Reference numeral 3 denotes a carriage motor as described above that uses the driving force to cause a carriage of the carriage unit 2 to have a reciprocating movement in the main scanning direction. The carriage is mounted with a printing head 112 in a detachable manner. Reference numeral 5 denotes the paper feeding motor (also called as paper feeding motor) as described above that uses the driving force to cause a printing medium (e.g., paper) to be transported in the sub scanning direction. Reference numeral 113 denotes a capping motor that drives a cap member provided at the home position of the carriage to cap the ink ejecting opening of the printing head 112, thereby blocking the ink ejecting opening from outside air to prevent the nozzle from being dried. Reference numeral 115 denotes a motor driver for driving the carriage motor 3. Reference numeral 116 denotes a motor driver for driving the paper feeding motor 5. Reference numeral 114 denotes a motor driver for driving the capping motor 113. A console 106 has a keyboard switch and a display lamp or the like.

The home position sensor 107 is provided in the vicinity of the home position of the carriage and detects that the carriage having the printing head 112 reaches the home position. Reference numeral 109 denotes a sheet sensor that detects the existence or nonexistence of the printing medium (e.g., printing paper), i.e., whether or not the printing medium is supplied to a printing section of the printing apparatus.

The ink jet printing head 112 of this example is an ink jet printing head that uses a method for using the thermal energy to cause the ink to have the status change by the film boiling, thereby ejecting ink droplets. This printing head 112 includes, for example, "m" (e.g., 64) ink ejecting openings arranged to intersect with the main scanning direction and "m" heaters (electrothermal converter) corresponding to the respective ejecting openings. Reference numeral 111 denotes a driver for driving the heaters of the printing head 112 in accordance with the printing information signal. Reference numeral 120 denotes a power source section for supplying electric power to the respective sections of the printing apparatus that has an AC adapter and a battery as a driving power source apparatus.

In the above configuration, the MPU 102 is connected, via the communication interface 122 and/or the memory card interface 124 with the external device, a data host apparatus (e.g., digital camera, computer, memory card driver). The MPU 102 controls, in accordance with the instruction from a user from the panel 106 or the like, the communication with these machines and collects pieces of object information or the like required for the printing based on the processing procedure of programs stored in the control ROM 106 and the printing information accumulated in the RAM 106. The MPU 102 also receives a command and a printing information signal sent from these host apparatuses to control, in accordance with these instructions, the printing operation of the received information.

The host apparatus 123 for sending the to-be-printed data to the printing apparatus of this example sends, as in the case of the communication with a conventional normal printing apparatus, the data required for the printing via the interface 122. Then, when the printing apparatus is a personal computer (PC), the host apparatus 123 regularly sends a command to the top of the data. This command describes: the type of a medium to which the printing is performed (e.g., type of medium (e.g., regular paper, OHP, gloss paper) and type of a special printing medium (e.g., print film, heavy paper, banner paper)); the size of the medium (e.g., A4, A4 letter, A3, B4, B5, envelop, postcard); the printing resolution (draft, high resolution, medium resolution, highlighting of a particular color, black and white/color); the paper feeding cassette (information regarding the paper feeding source of the printing medium (e.g., ASF, manual feeding, bin 1, bin 2)); and the existence or nonexistence of the automatic detection of object information. By receiving such a command, the printing apparatus performs the printing based on various kinds of pieces of data stored in the ROM 105.

The host apparatus 123 also may send, as a command, the information regarding whether a processing liquid is coated or not, for example. In accordance with such information, the printing apparatus reads the data required for the printing from the ROM 105 to perform the printing based on the data. Data read from this ROM include, for example, the number of path(s) of the multi-path for performing the printing; the type of the mask used for printing each path; conditions for driving the printing head (e.g., shape of a pulse applied as a driving pulse and the application time); the size of a droplet (ink droplet); paper feeding conditions; and the movement speed of the carriage.

When the host apparatus 123 is not a PC but a device such as a digital camera and when the layout of the object information recorded in the memory card 125 is performed for the printing, the operation is performed as shown below. Specifically, in accordance with the procedure read out from the above-described ROM, the layout information determined based on the user instruction from the console 106 is read from the above-described ROM and is analyzed, thereby performing the printing operation while generating the to-be-printed image.

Figure 3:
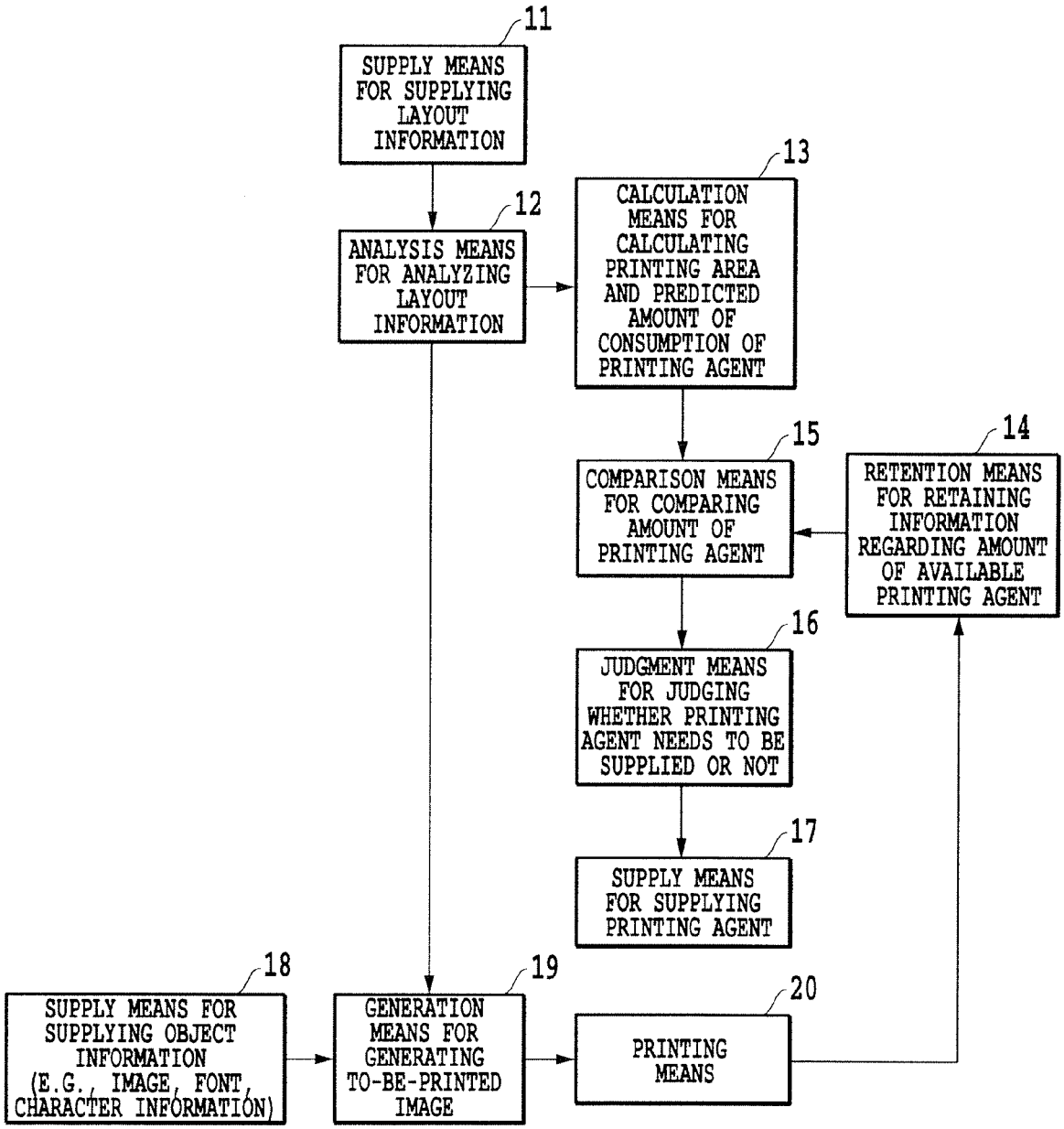
FIG. 3 is a block diagram illustrating the structure of the processing section for the information of to-be-printed image in the printing apparatus of FIG. 1.

FIG. 3 is a block diagram for explaining the processing section of the information of the to-be-printed image (printing image).

Reference numeral 11 denotes a layout information supply means for supplying the layout information to be printed. Reference numeral 12 denotes an analysis means for analyzing the supplied layout information. Reference numeral 13 denotes a calculation means for calculating, based on the analyzed layout information, the area of the part in which the printing is performed (area of printing region) and the amount of the printing agent (ink) to be consumed in this part (estimated printing agent amount). Reference numeral 14 denotes a retention means for retaining the information regarding the amount of the printing agent that remains in the sub tank and that can be actually used (ink remaining amount) to present the information. Reference numeral 15 denotes a comparison means for comparing the estimated printing agent amount calculated by the calculation means 13 with the actually-available printing agent amount presented by the retention means 14. Reference numeral 16 denotes a judgment means for judging, based on the result of the comparison by the comparison means 15, whether printing agent needs to be supplied or not. Reference numeral 17 denotes a printing agent supply means for actually supplying, when the judgment means 16 judges that printing agent needs to be supplied, ink to the sub tank.

Reference numeral 18 denotes a supply means for providing the object information to be developed when the printing is actually performed (e.g., image, character, graphics, font). Reference numeral 19 denotes a generation means for providing the layout to be actually printed, based on the layout analyzed by the analysis means 12 and the referred object information, thereby generating the to-be-printed image. Reference numeral 20 denotes a printing means for printing an image generated by the generation means 19 onto the printing medium (e.g., paper).

FIG. 3 shows the most basic structure of the present invention.

The term "layout information" means any information regarding the layout of the image to be printed. Based on this information, all the information to be printed (e.g., image, character string, graphics, font) can be tracked to be referred. This information also provides the information regarding the size of the maximum region in the layout. The layout information also includes all information for obtaining the area of the part on the printing medium in which no image is printed (i.e., margin part), for example.

Figure 4A:
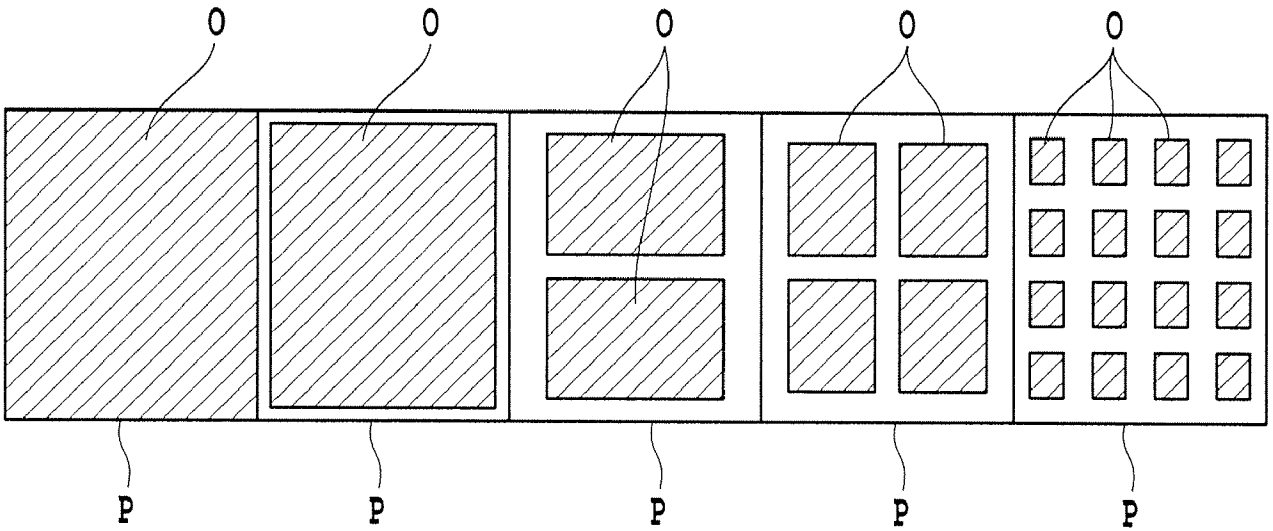
FIGS. 4A and 4B are concept diagram for explaining the method for estimating the ink usage in the printing apparatus of FIG. 1.
Figure 4B:
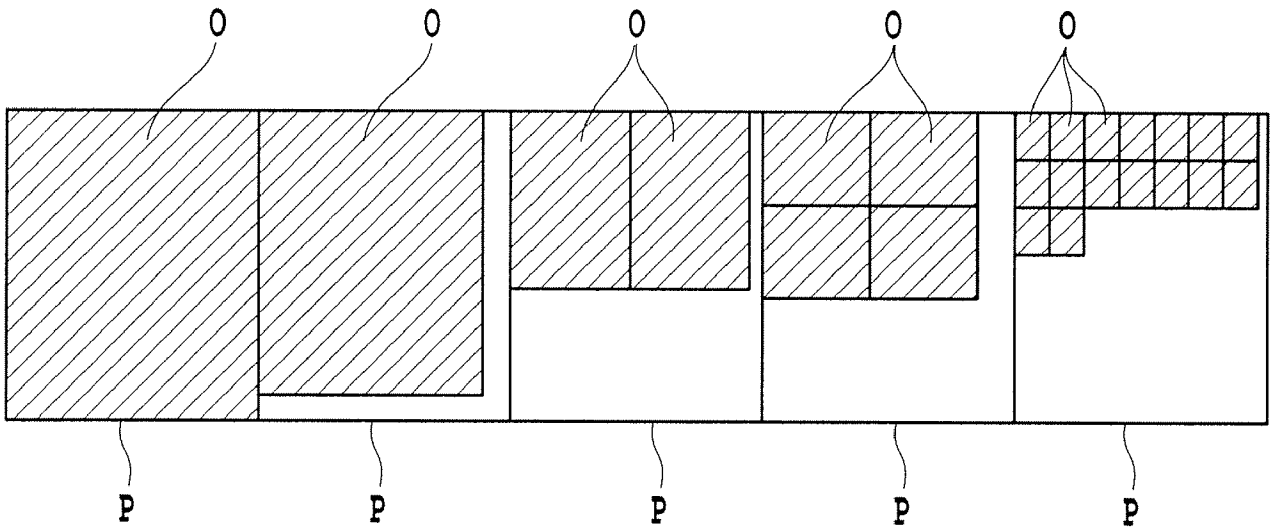

FIG. 4A and FIG. 4B are diagrams for explaining the relation between the layout information and the prediction of ink usage.

FIG. 4A shows the status in which one page of the printing medium P has thereon the layout of various pieces of object information O. FIG. 4B shows the status in which, in the one page of printing medium P, regions of these object information O are clustered. Although the layout status of FIG. 4A does not tell clearly, as can be seen from FIG. 4B in which such regions are clustered to show the proportion of the areas of margin regions, the proportion of the margin regions increases as the number of pieces of the object information O increases. In the case of the layout as shown at the right end of FIG. 4A in which a general index layout is used to perform layout pieces of object information, the clustered printing areas are equal to or smaller than the half of those when a full page printing is performed as shown at the left end of FIG. 4A. This is understood by comparing the layout at the right end of FIG. 4B with that at the left end of FIG. 4B.

The layout of pieces of object information also can be performed so that margins there among can be eliminated. From at least FIG. 4A and FIG. 4B, it is clear that, when the layout of a plurality of pieces of general object information is performed, information of the layout (layout information) also can be used to predict the ink consumption amount. The predicted ink consumption amount is smaller than the ink consumption amount of a full page printing by an amount in proportion to the result of the analysis of the layout information. Then, the predicted ink consumption amount and the predicted ink remaining amount in the sub tank can be used to specify an optimal timing at which ink is supplied from the main tank to the sub tank.

In this way, there are cases in which the analysis of the layout information provides an immediate detection of the amount of ink consumption.

In the case where the ink consumption amount is desired to be accurately calculated with regards to a print layout in which a layout of a plurality of pieces of object information (e.g., index layout) is performed in particular, corresponding large amount of actual data of object information must be accessed. In such a case, the time required for the previous reading processing may be enormously long. Although there is no problem in the case of a printing medium that is a card-sized paper, a printing medium that is an A4-sized paper or the like may require the layout of more than 80 images. Thus, if one image is assumed to have a capacity of few MBs, even only the processing for accessing a card via an interface for example requires more than a few minutes of time.

When the layout analysis can be used to easily judge that a large amount of margin region exists, it is possible to recognize that the ink amount remaining in the sub tank is about the half of the amount required for full page printing of one page. In this case, there is no need to load the image for analysis. This is one of advantages provided when the layout analysis processing means is included in the printing apparatus.

Figure 5:
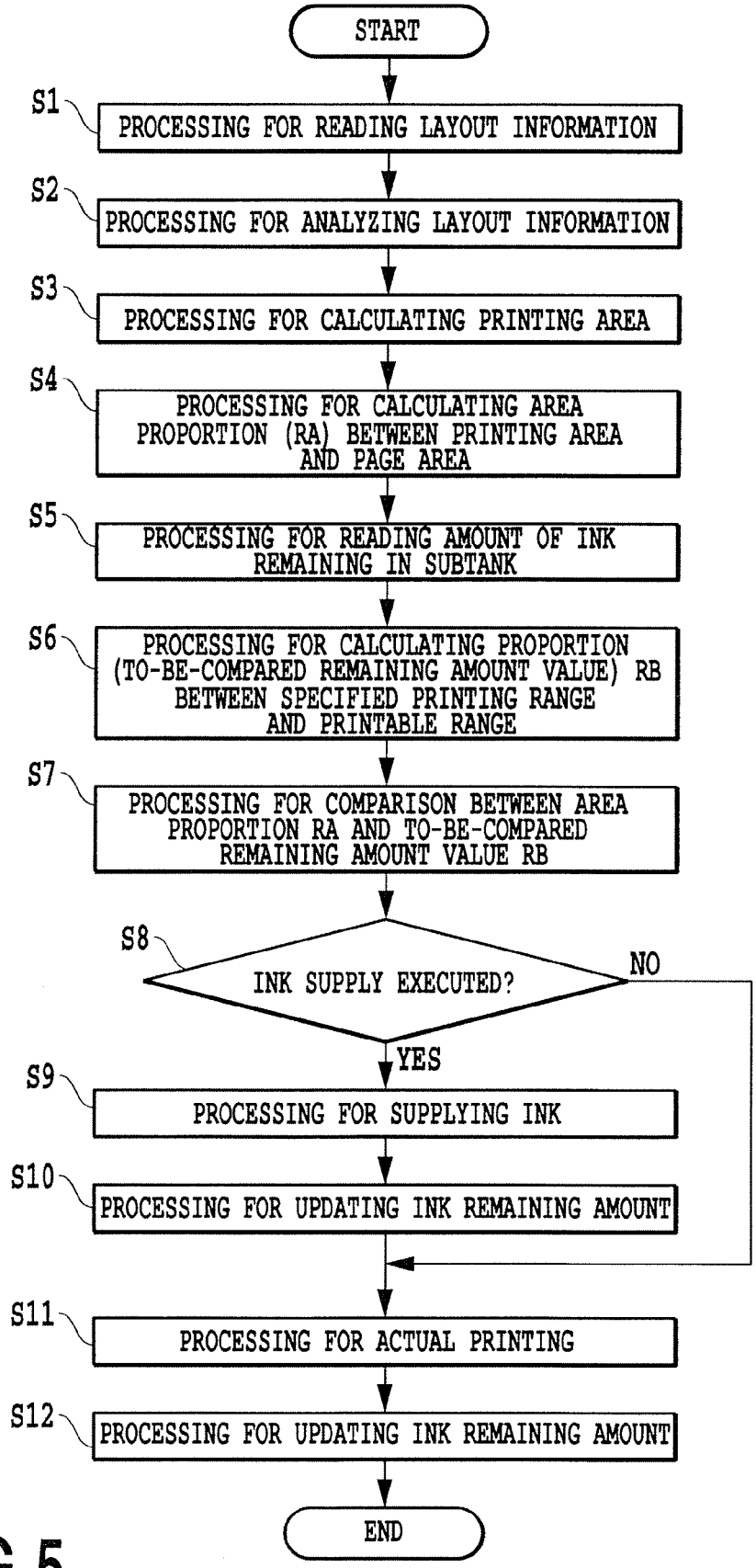
FIG. 5 is a flowchart for explaining the processing procedure in the printing apparatus of FIG. 1.

FIG. 5 is a flowchart for explaining the processing procedure in the printing apparatus. A program for executing the processing in FIG. 5 is stored in the control ROM 105 and is executed by the MPU 102.

First, in Step S1, the layout information is read, via the interface 124 or 122, from a ROM or a memory card or is received from a host PC (reading processing). When a device (e.g., digital camera) is connected via a device interface to the printing apparatus, the layout information recorded in the ROM or memory card of the digital camera may be read.

Next, in Step S2, the layout information is analyzed (analysis processing). For example, when the layout information is described by a markup language (e.g., XML, HTML), then the parse processing or the like is used to convert the information to have a data type that can be processed by the MPU 102 at a later stage. In this way, the processing by Step S2 means a processing, for example, for converting the layout information to have a data type that can be processed by the MPU 102. When the layout information is of a binary type or a structure type that can be directly processed by the MPU 102 without conversion, a processing for placing the data to an appropriate RAM region is also performed, for example. When the layout information is template data having a unique type for example, a processing for developing the data is performed, for example.

Next, Step S3 calculates, when the layout of the object information is performed and printed based on the layout information analyzed in Step S2, an area (printing area) for which the image must be printed on a printing medium (e.g., paper) by ejecting ink (calculation processing).

Next, Step S4 calculates, with regards to the area on the printing medium to be printed, the proportion of the printing area calculated in Step S3 (area proportion) Ra (proportion calculation processing). In this example, a processing for calculating the to-be-printed area against the page area for one page of a printing medium is performed.

Next, Step S5 reads data for the amount of ink remaining in the sub tank (reading processing). The read ink remaining amount does not have a value that can be directly compared with the proportion Ra of the printing region calculated in Step S4. Thus, the ink remaining amount in the sub tank read by Step S5 needs to be converted to have a value that can be compared.

The sub tank generally has a capacity that is designed based on a certain specification. Such a specification is determined in consideration of factors such as the cost for running the printing apparatus, the estimated frequency of use, ink usage, and the design of the ink supply mechanism, for example. One printing apparatus is designed to have, for example, an inner space for sufficiently supplying the ink even in the middle of the printing for one page of a printing medium and to include a motor that is placed so as not to have an influence on the paper feeding or the like. Such a printing apparatus has no problem in having the sub tank capacity that is designed to be smaller than the maximum estimated ink consumption amount for the printing of one page. The reason is that an ink supply operation can be freely performed, even in the middle of the printing of one page and whenever the ink in the sub tank is empty.

However, in reality, many printing apparatuses have a structure that cannot supply the ink in the middle of the printing of one page due to various layout-related and cost-related factors (e.g., printing apparatus body having a more compact size, motor designed to be commonly used, overlap between the paper paths (printing medium transportation system) and the ink supply mechanism). Due to this reason, the sub tank is generally designed to have a capacity exceeding the maximum estimated ink consumption amount for the printing of one page in consideration of the amount of ink used by a minor recovery operation in the middle of the printing, for example. The recovery operation is a processing operation for discharging, in order to maintain a favorable ejecting status of a printing head, the ink that does not contribute to the printing of an image.

Due to the situation as described above, when a sub tank having the smallest capacity is designed, the sub tank may be designed based on the maximum estimated ink consumption amount for the printing of one page. In this case, it is clear that the current amount of ink remaining in the sub tank has such a proportion to the capacity of the sub tank that has a value that can be directly compared with the proportion Ra of the printing area to the page area calculated in Step S4 (area proportion).

In such a case, then Step S6 calculates, by assuming the proportion between the specified printing range and the printable range (to-be-compared remaining amount value) as "Rb", the proportion of the ink remaining amount "Tr" in the sub tank to the sub tank capacity "Tc". Specifically, when the sub tank is designed to have a capacity by using the estimated maximum ink consumption amount for printing one page as one standard, the to-be-compared remaining amount value Rb is obtained by the following formula (1). The to-be-compared remaining amount value Rb is compared with the area proportion Ra calculated by Step S4.

$$Rb=Tr/Tc \quad (1)$$

However, in the case of some designs of a sub tank, the formula (2) or (3) shown below can be used to calculate the to-be-compared remaining amount value Rb. Hereinafter, they will be described as another example of a sub tank.

(Another Example of Design of Sub Tank)

For example, in the case of a printing apparatus in a large-sized print station or the like must be used to use a main tank having a large ink capacity to perform a printing of a large amount for a long time, the sub tank need not be designed to have the minimum capacity as described above. In this case, the sub tank may be designed to have a larger capacity (e.g., the sub tank may be designed to have a capacity by which 10 to 20 printing media can be printed). A main tank used for such a machine presumably has an extremely large capacity in which ink for printing 100 to 1000 printing media can be stored.

In such a case, the to-be-compared remaining amount value Rb can be calculated by the following formula (2). The to-be-compared remaining amount value Rb is compared with the area proportion Ra calculated by Step S4. This to-be-compared remaining amount value Rb can be calculated by the ink remaining amount Tr in the sub tank, the sub tank capacity Tc, and the number of printing media that can be continuously printed by the ink corresponding to the sub tank capacity (maximum number for continuous printing) Pmax.

$$Rb=Tr/(Tc/P\max) \quad (2)$$

In this case, the to-be-compared remaining amount value Rb frequently exceeds 1 (i.e., 100%) while the area proportion Ra calculated by Step S4 is normally equal to or lower than 1. However, this formula (2) is based on the assumption that such a printing medium (paper) is used that requires a certain fixed amount of ink. In actual cases, the estimated maximum ink consumption amount for one printing medium is different depending on the size or kind of a paper fed as the printing medium. The proportion value of the printing region in one page, of course, also has a different meaning depending on the paper size or the like specified by the layout information. Due to such a background, the following formula (3) can be actually used as the simplest calculation method to calculate the to-be-compared remaining amount value Rb. "Qmax" denotes the number of printing media requiring the maximum ink consumption amount that can be continuously printed by the ink corresponding to the sub tank capacity (number of continuous printing).

$$Rb=Tr/(Tc/Q\max) \quad (3)$$

As described above, so long as the number of continuous printing Qmax based on the printing media requiring the maximum ink consumption amount is used, the worst case can be avoided in which the sub tank has ink shortage while one printing medium is being printed. Such a printing medium requires the maximum ink consumption amount that uses a large amount of ink because of the highest ink 5 absorption power and the poor coloration.

Next, Step S7 compares the area proportion Ra calculated by Step S4 with the to-be-compared remaining amount value Rb calculated by Step S6 (comparison processing). If the area proportion Ra is larger than the to-be-compared remaining amount value Rb, ink needs to be supplied.

Then, when Step S8 performs the judgment processing to judge that ink must be supplied, then the processing proceeds to Step S9 in which ink is supplied from the main tank to the sub tank. Next, Step S10 resets the data for the ink remaining amount of the sub tank as "ink full" (processing for updating the ink remaining amount). When ink supply is not required, then the processing proceeds from Step S8 to Step S11 in which an actual printing processing for performing the printing operation is performed.

When the actual printing processing is completed, then Step S12 updates, based on the amount of the actually-used ink for example, the data regarding the amount of ink remaining in the sub tank (processing for updating the ink remaining amount).

It is noted that the processing of FIG. 5 is not limited to the processing for printing one page. For example, there may be a case in which printing media having the number exceeding the maximum printable pages by the ink corresponding to the capacity of the sub tank are specified to be printed. In such a case, the processing for analyzing the layout is used to predict how much ink will be consumed for printing a plurality of continuous pages. Then, factors regarding whether the ink remaining amount in the sub tank is sufficient for printing the plurality of continuous pages are collectively judged before the plurality of continuous pages are actually printed. Even in this case however, the processing flow of FIG. 5 may be required to be performed a plurality of times in order to print all of the specified media.

Second Embodiment

Figure 6:
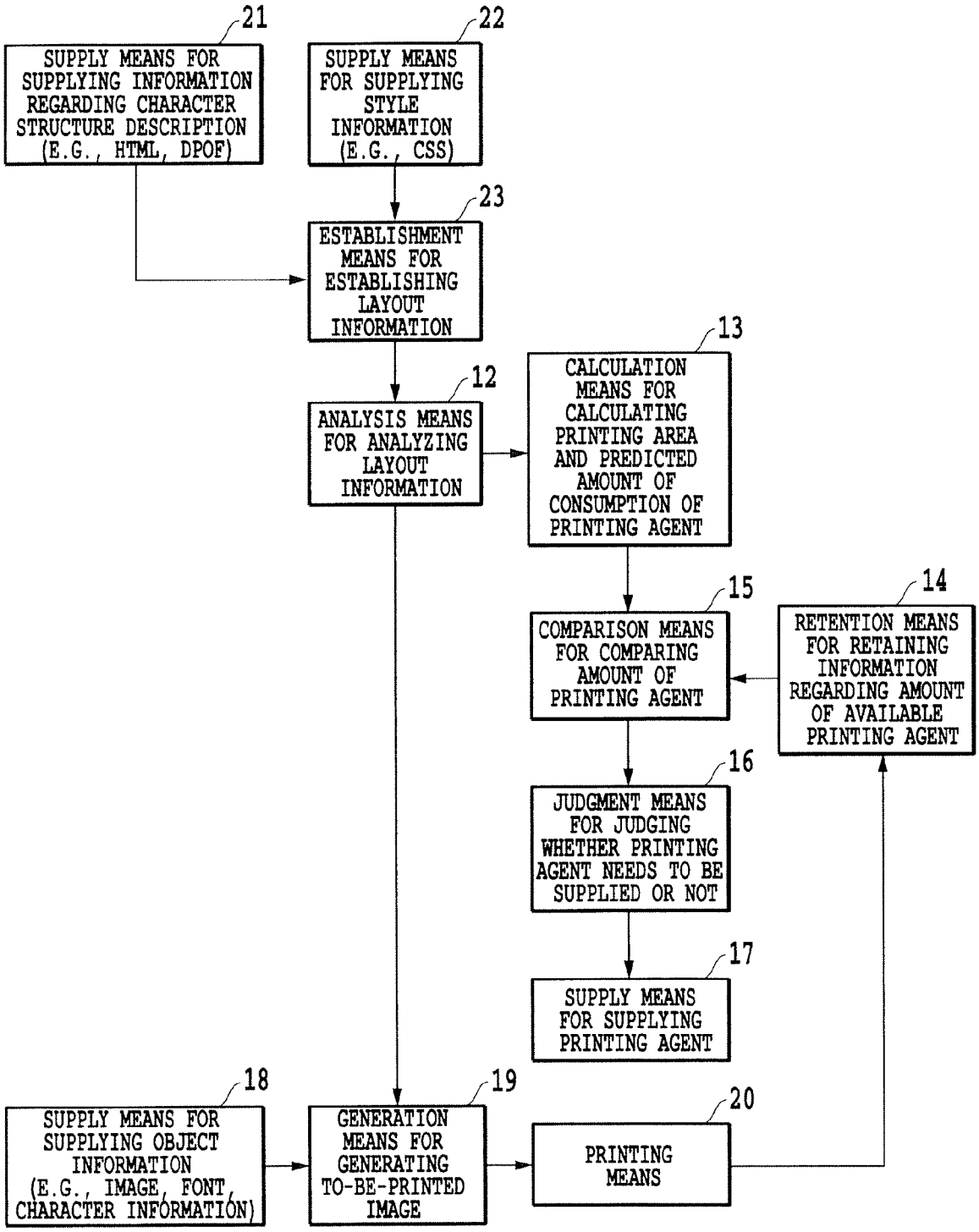
FIG. 6 is a block diagram for explaining the structure of the processing section for the information of to-be-printed image in the printing apparatus of the second embodiment of the present invention.

FIG. 6 is a block diagram for explaining the processing section of the information of to-be-printed image in the second embodiment of the present invention.

Reference numeral 21 denotes a supply means for supplying the information describing the document structure that describes the document structure of the object information to be printed or the information regarding the formation in one page. Reference numeral 22 denotes a supply means for supplying the style information that maintains and supplies the style information that is used for adding the actual layout information to the document structure supplied by the document structure information supply means 21. Reference numeral 23 denotes a layout information establishment means for establishing, based on the document structure information supplied by the supply means 21 and the style information supplied by the supply means 22, the layout information used for an actual printing. The other means 12 to 20 are the same as those described with regards to the above-described embodiment of FIG. 3.

In this example, collective description or order description information are analyzed with regards to the contents in accordance with, in particular, specifications such as Hyper Text Markup Language (HTML), Extensible Hyper Text Markup Language (HTML), Digital Print Order Format (DPOF), or Data Print Services (DPS) and the layout information in the layout system using a style sheet such as Control Scrambling System (CSS).

As well known, a document structure description markup language such as HTML only markups the structure or the meaning of the document and is not described in consideration of a particular layout. Thus, it is impossible to determine the layout by merely reading document structure description such as HTML. In order to obtain the layout by reading only HTML as done by many browsers, a default style must be previously prepared. The default style information is used as a substitute for the style information that really needs to be supplied so that the layout information can be established.

There are generally other kinds of information such as DPOF and DPS specifications that specify only the order of photographs to be printed and the method for allocating the photographs to pages. In the case of such information (e.g., multi-print job in accordance with DPOF specification), how many photograph images can be allocated to one page (e.g., one or two photographs in one page) can be specified. The DPS specification can provide such layout information by which the number of photographs allocated to one page (e.g., 1UP, 2UP . . . 255UP, index print) can be specified. However, when this information is actually used to obtain the layout, a problem as described below is found. Specifically, a problem is found according to which no rules for the layout is told (e.g., the layout information of 2UP does not tell whether or not it is acceptable to layout the two images to have the same size, whether or not one image needs to have a larger size than that of the other image, whether or not these images need to be arranged in a longitudinal direction or in a lateral direction, whether or not these images may be partially superimposed or not). Thus, it is clear that so-called layout information in the specification in such a case does not tell any information regarding the style that is required for establishing the information regarding the final layout.

In view of the above, this example establishes the layout information based on the information regarding the document structure description or the collective description of object information and the information regarding the style description.

Figure 7:
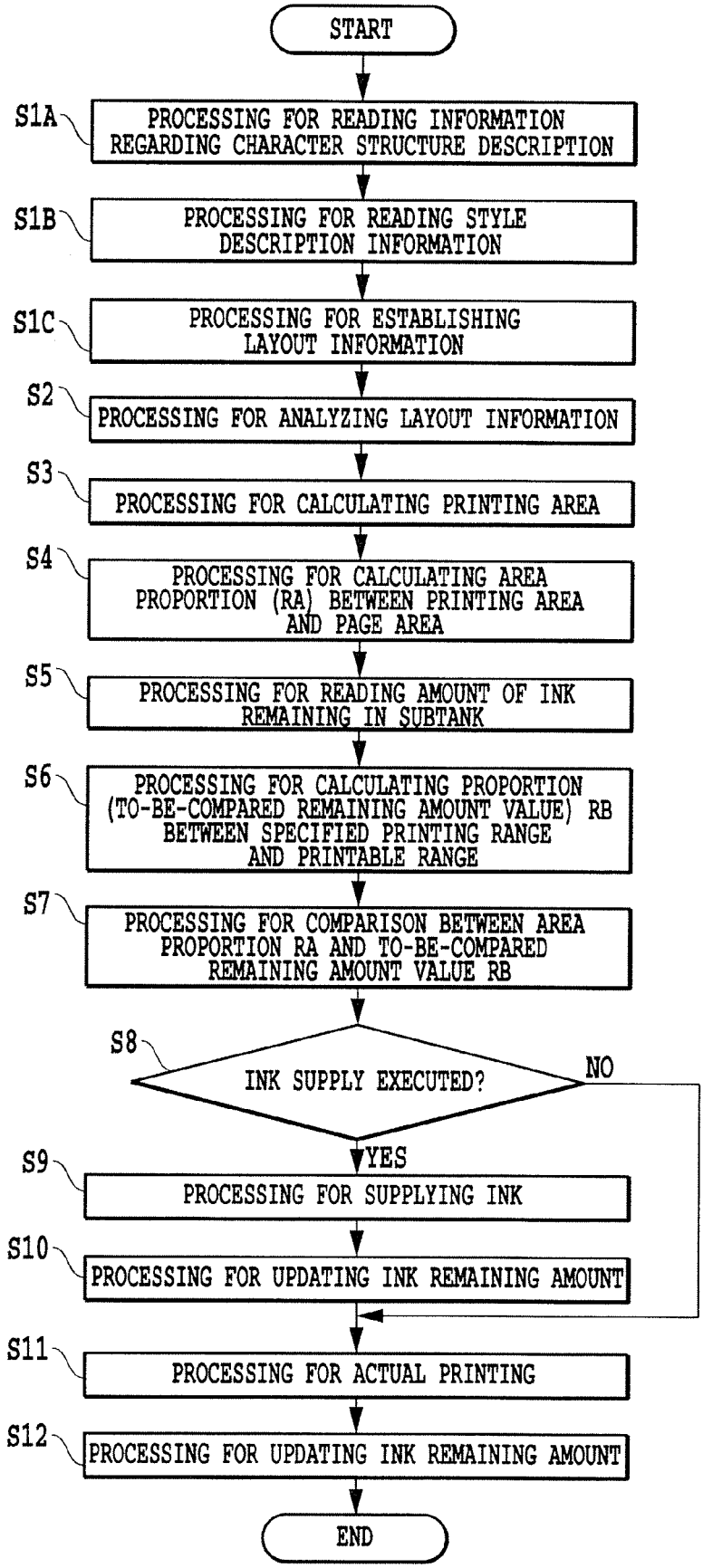
FIG. 7 is a flowchart for explaining the processing procedure in the printing apparatus of FIG. 6.

FIG. 7 shows a flowchart for explaining the processing procedure in this example.

In step S1A, the information describing the document structure (e.g., HTML) is read. In step S1B, the style information (e.g., CSS) is read. If a conventional method for describing HTML is used, the information describing the document structure may be embedded with the information describing the style sheet (e.g., CSS). In this case, Step S1B may be included in Step. S1A. In step S1C, the layout information is established based on the information describing the document structure and style information thus read.

The subsequent Steps S2 to S12 are the same as those in the above-described embodiment of FIG. 5. Specifically, Step S2 analyzes the layout information established in Step SIC and Step S3 calculates the area of the part to be printed. Step S4 calculates the proportion of the printing area (Ra) to the page area that is used for the subsequent comparison processing. Step S5 reads the amount data regarding ink remaining in the sub tank. Step S6 calculates the to-be-compared remaining amount value Rb. Step S7 compares the area proportion Ra with the to-be-compared remaining amount value Rb. Step S8 judges whether ink needs to be supplied to the sub tank or not.

If it is judged that ink needs to be supplied to the sub tank, then the processing proceeds to Step S9 in which ink is supplied to the sub tank. Thereafter, Step S10 initializes the information for the amount of ink remaining in the sub tank as "ink full". If it is judged that ink does not need to be supplied, then the processing proceeds to Step S12 in which an actual printing operation is performed. After the actual printing operation, Step S13 updates the information regarding the ink remaining in the sub tank, thereby completing the processing.

FIG. 8A and FIG. 8B show an example of the information describing the document structure and the style sheet.

The document structure description only specifies that four images in the lateral direction and two images in the longitudinal direction should be arranged in a grid-like manner and does not specify the size of each image. If an enormously large-sized image is included in these images, a risk is caused in which the layout of that image may be performed to protrude the page region, thus causing most of the images not to be able to be seen, for example.

To prevent this, the style sheet specifies the image size having 300 pixels in the lateral direction and 200 pixels in the longitudinal direction. As a result, a fixed layout can be realized without depending on the size of an original image.

Third Embodiment

Figure 9:
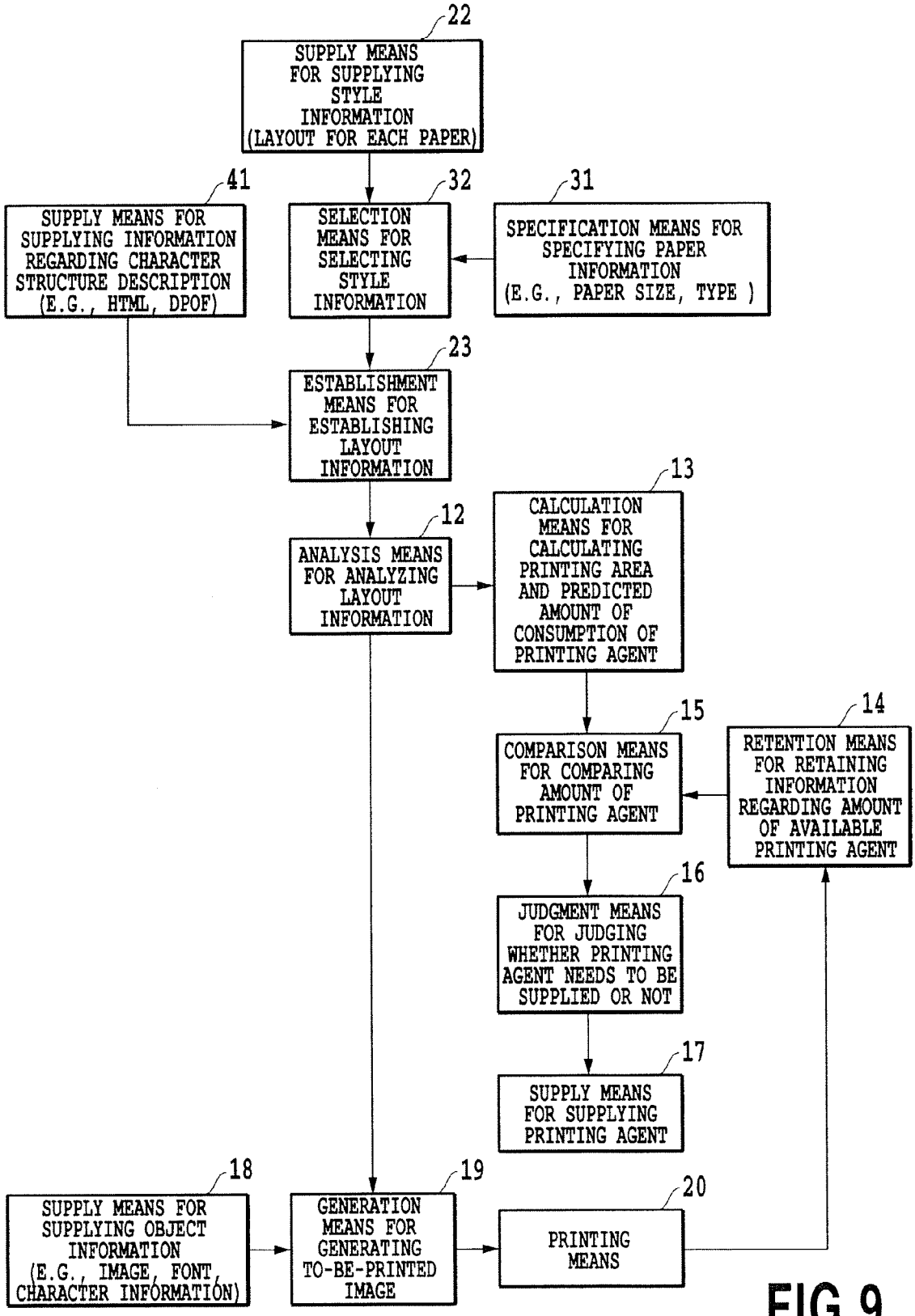
FIG. 9 is a block diagram illustrating the structure of the processing section for the information of to-be-printed image in the printing apparatus of the third embodiment of the present invention.

FIG. 9 is a block diagram for explaining the processing section in this embodiment.

The supply means 21 supplies the information describing the document structure that describes the document structure of the object information to be printed or describes the information regarding the allocation on one page, for example. The supply means 22 retains and supplies the style information that is used for adding the information regarding an actual layout for each kind of paper to the document structure supplied by the supply means 21 for supplying the document structure information. Reference numeral 31 denotes a paper information specification means that specifies the information regarding the printing medium (e.g., paper) to be processed by the printing apparatus (e.g., paper size, paper type). Reference numeral 32 denotes a style information selection means that additionally considers the information supplied from the supply means 31 (e.g., paper size, paper type) to select an appropriate piece of information from a plurality of pieces of style information supplied from the supply means 22.

Reference numeral 23 denotes a layout information establishment means that establishes, based on the document structure information supplied by the supply means 21 and the style information selected by the selection means 32, the layout information used for an actual printing. The other means 12 to 20 are the same as those of the above-described embodiment of FIG. 3.

When the printing apparatus analyzes the layout, information regarding which kind of a printing medium should be printed may be obtained in some cases. In some cases, the layout may be different depending various factors (e.g., when there is a document structure description or a specification regarding the number of photographs formed in one page, whether or not the layout should be printed on a card, whether or not the layout should be printed on a postcard, or whether or not the layout should be printed on an A4-sized paper). The layouts in the respective printing media may be different while having some similarity. For example, a paper having a certain size can be used for an edgeless printing in which the entire printing surface is printed while a paper exceeding the certain size cannot be used for the edgeless printing in some cases. In this way, the layout principle may be fundamentally different depending on the scan direction or the limitation on the mechanism of the printing apparatus, for example. There also may be cases in which a certain paper type is difficult to be used for the edgeless printing, a paper such as a pre-print paper has a region in which the printing is prohibited, or a paper like a seal paper has a predetermined layout therein.

Thus, this embodiment establishes the layout information by additionally considering the information regarding the size and type of the paper to select an appropriate piece of information from a plurality of prepared pieces of style information.

Figure 10:
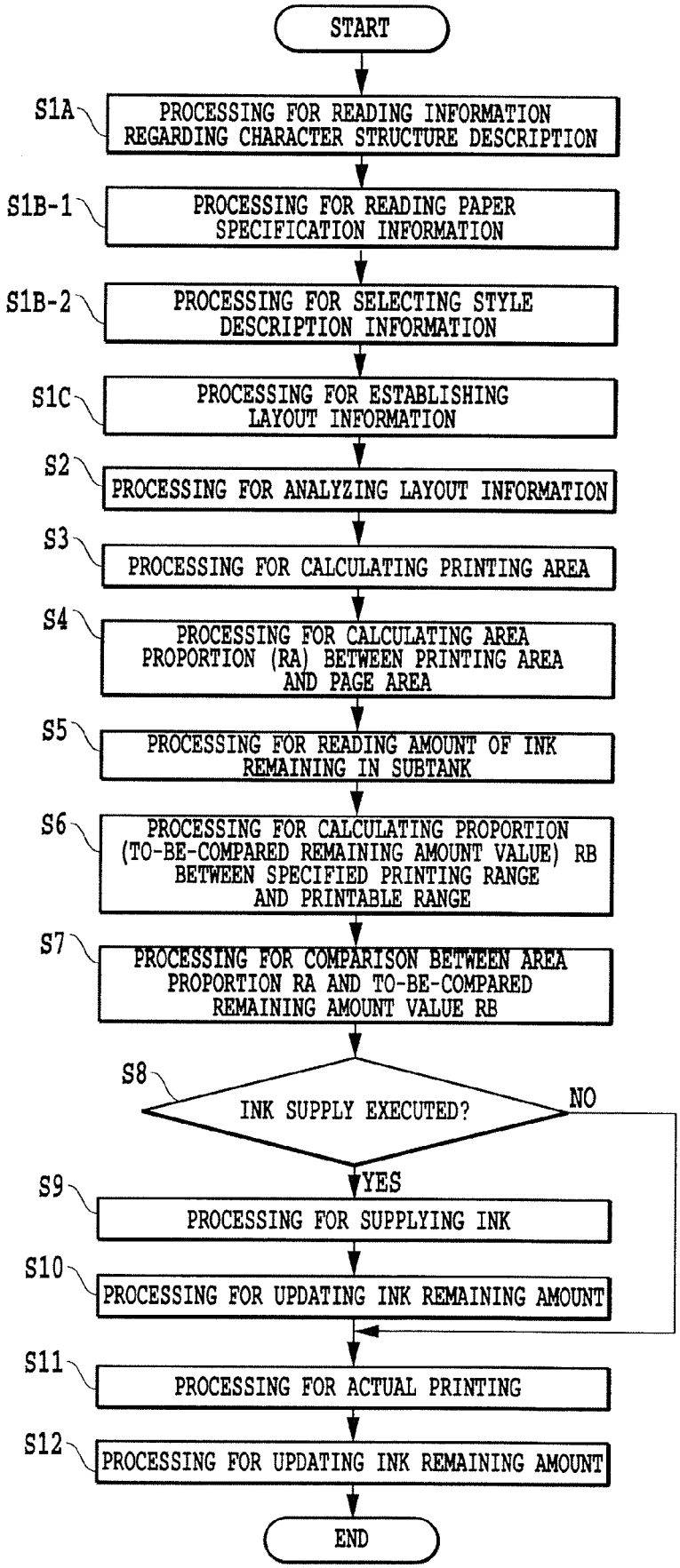
FIG. 10 is a flowchart for explaining the processing procedure in the printing apparatus of FIG. 9.

FIG. 10 is a flowchart for explaining the processing procedure in this example.

Step S1A reads information describing the document structure (e.g., HTML). Next, Step S1B-1 reads the information regarding the printing medium specified by a panel or the like of the printing apparatus, for example (processing for reading paper specification information). A sensor or the like may be of course used to read the information regarding the result of an automatic determination of the size or type of the paper. In this example, such paper information regarding a paper may be any information regardless of how the paper information is specified or designated so long as the paper information presents the information for selecting the style information. Thus, the paper information may be of course used, for example, for a size-specified print job for DPOF according to which the document structure description or the page formation information specifies a certain paper. Paper information may be any information regardless of how the paper information is specified so long as the paper information can be read so that the style information can be selected by the next Step S1B-2.

Step S1B-2 additionally considers the paper information to select an appropriate piece of information from a plurality of pieces of prepared style information. Step S1C establishes, based on the information describing the document structure thus read and the style information, the information regarding the layout to be printed.

Subsequent Steps S2 to S12 are the same as those of the above-described embodiment of FIG. 5. Specifically, Step S2 analyzes the layout information established by Step S1C. Step S3 calculates the area of the part to be printed. Step S4 calculates the proportion Ra of the printing area to the page area for the subsequent comparison processing. Step S5 reads the amount data regarding ink remaining in the sub tank. Step S6 calculates the to-be-compared remaining amount value Rb. Step S7 compares the area proportion Ra with the to-be-compared remaining amount value Rb. Step S8 judges whether ink needs to be supplied to the sub tank or not.

If it is judged that ink needs to be supplied to the sub tank, the processing proceeds to Step S9 in which ink is supplied to the sub tank. Thereafter, Step S10 initializes the information for the ink remaining amount of the sub tank as "ink full". If it is judged that ink does not need to be supplied, then the processing proceeds to Step S12 in which an actual printing operation is performed. After the actual printing operation, Step S13 updates the information regarding the ink remaining in the sub tank, thereby completing the processing.

Fourth Embodiment

Figure 11:
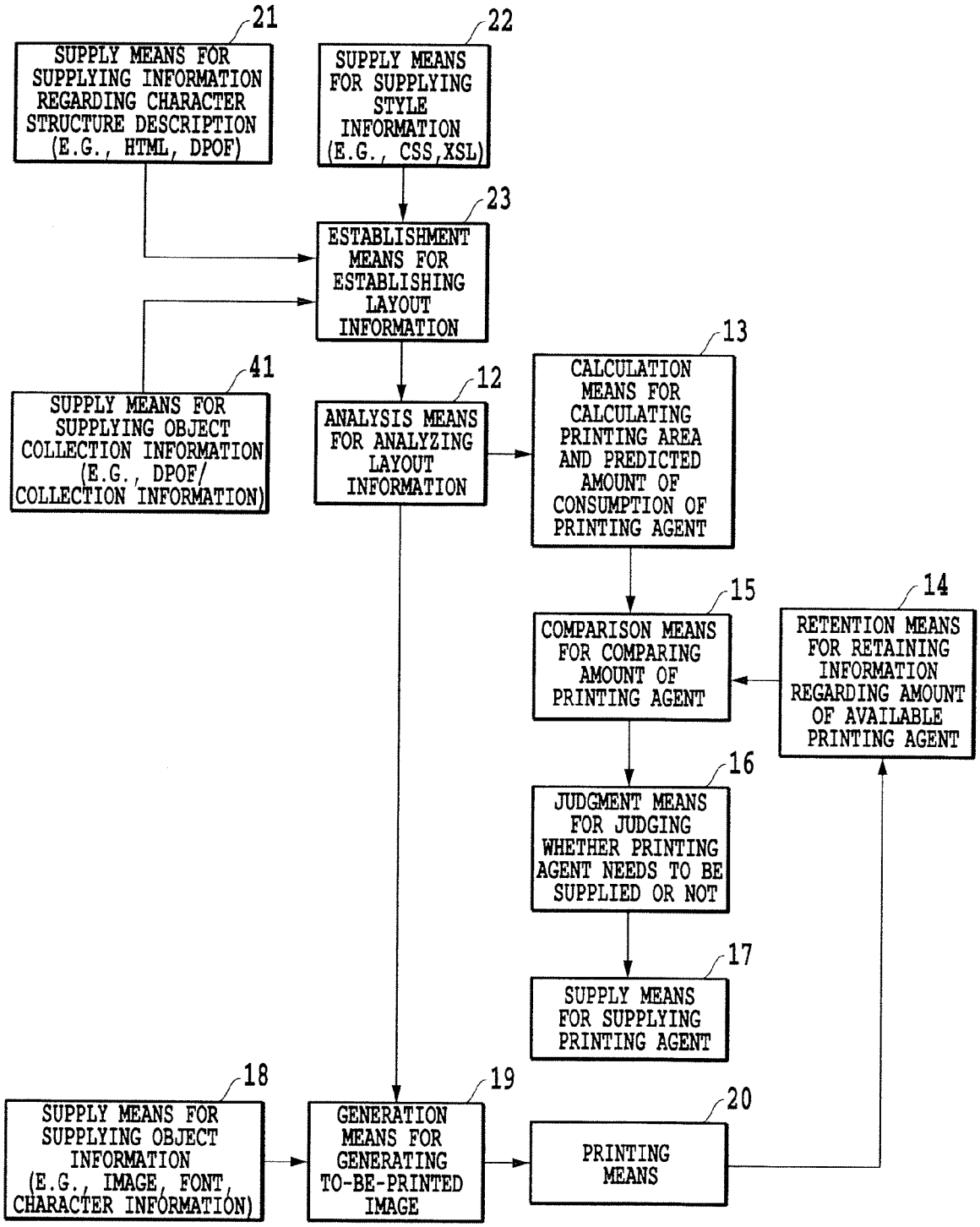
FIG. 11 is a block diagram illustrating the structure of the processing section for the information of to-be-printed image in the printing apparatus of the fourth embodiment of the present invention.

FIG. 11 is a block diagram for explaining the processing section in this embodiment.

The supply means 21 supplies the document structure description information that describes the document structure of the object information to be printed or the information for the allocation on one page, for example. The supply means 22 retains and supplies the style information that is used for adding the information regarding an actual layout for each kind of paper to the document structure supplied by the supply means 21 for supplying the document structure information.

Reference numeral 41 denotes a supply means for supplying the information regarding the collection of object information that provides the information regarding the collection of pieces of object information referred by the layout information. Reference numeral 42 denotes a layout information establishment means that establishes the layout information used for an actual printing based on the document structure information supplied by the supply means 21 for supplying the information describing the document structure; the style information supplied by the supply means 22 for supplying the style information; and the information regarding the collection of pieces of object information supplied by the supply means 41 for supplying the information regarding the collection of pieces of object information. The other means 12 to 20 are the same as those of the above-described embodiment of FIG. 3.

Figure 12:
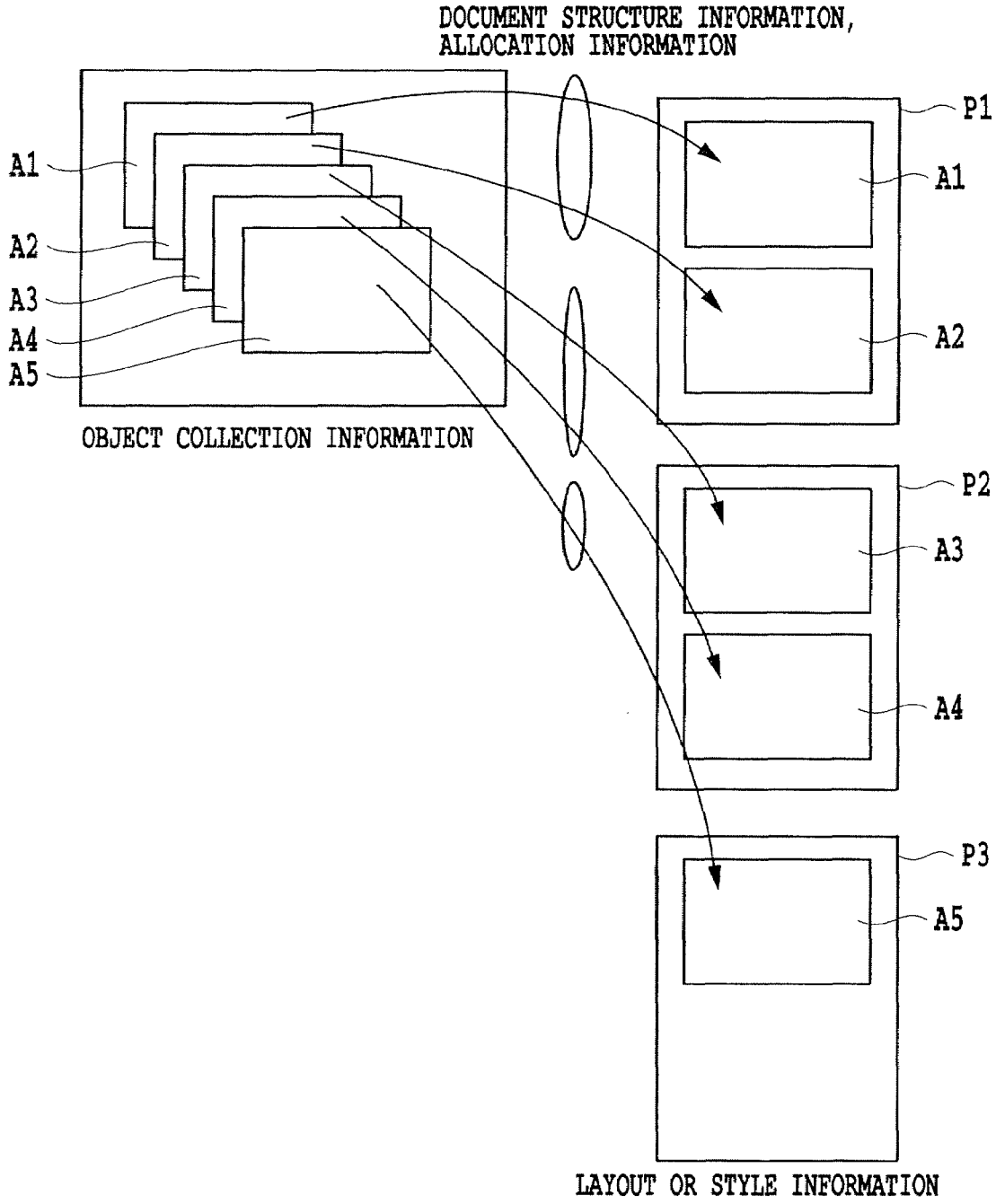
FIG. 12 is a concept diagram for explaining the layout processing of the collection of pieces of object information in the printing apparatus of FIG. 11.

FIG. 12 is a concept diagram of a processing for applying the collection of pieces of object information to the layout.

A case will be described in which, for example, a job (e.g., DPOF, DPS) includes five images A1 to A5 and the layout of these five images A1 to A5 is performed to print every two of them on one page of a printing medium. In such a case, the first page of printing medium Pl and the second page P2 can have thereon two images, respectively. The third page P3 has thereon only the fifth image A5 and has thereon no further image. Thus, the third page of printing medium has such a layout in which only the upper half of the page is printed, as shown in FIG. 12. As a result, it is naturally expected that the third page P3 has such a layout that has much margin than those of the first page P1 and the second page P2, thus consuming much less ink.

As described above, in an actual printing in accordance with DPOF printing or DPS specification, the number of photograph images stored in a digital camera or a memory card is not divisible into the number for which images can be formed on one page. In such a case, a situation may be caused in which the ink consumption amount for the final page is significantly different from that for other pages.

Due to this reason, it is required to always consider, in a processing for calculating the ink consumption amount, the number of remaining photographs to be presented. Specifically, the different processing must be changed depending on a case where available layout positions on one page are all occupied by photographs and a case in which some of such positions are empty.

In view of this, this embodiment refers, when the establishment means 42 of FIG. 11 establishes the layout information, the information regarding the collection of pieces of object information supplied by the supply means 41. Then, while considering the number of pieces of object information (e.g., photograph) remaining in the collection of information whose layout should be done, the pieces of object information are sequentially allocated to layout regions. Then, when there is no further piece of object information to be allocated, then the layout processing is completed. By doing this, an area of "not-to-be-printed part" will not be added to the printing area calculated in the subsequent calculation processes.

Summary of Embodiments

The following section will describe the summary of the above-described embodiments of the present invention and other embodiments.

(1) The present invention analyzes the layout information to analyze the layout of pieces of object information in order to predict, prior to the processing for developing the to-be-printed image, the usage of the printing agent required for printing the object information whose layout is done based on the layout information. Then, the predicted usage of the printing agent can be compared with the amount of actually-available printing agent (i.e., amount of remaining printing agent that can be supplied) to determine the timing at which the printing agent is supplied.

When a template for determining the layout of pieces of object information is used as layout information, what kind of an image is put into a photograph frame, for example, is unknown until the printing apparatus is connected with a digital camera or the like. Contents of the image are also unknown until the image data is read from a digital camera (or a memory card) or the like and is developed. However, regions in which such to-be-printed images are arranged are not so different depending on the type of image. In view of this, the ink usage (consumption amount) can be estimated by considering the average or maximum value of ink usage (consumption amount) regarding the image printing area to compare such a value with a value of ink usage when an entire page of a printing medium is fully printed (full page printing). When an area in which an image is printed is smaller than the area of the printing medium, the ink usage required for printing the image is smaller than the ink consumption amount required for the full page printing by the area proportion. As a result, the ink usage can be estimated only based on the layout information, as described above. The ink usage amount will be estimated as the maximum ink usage when areas in which different images are printed are equal.

When a printing for the same layout is repeated for example, the ink usage for one printing may be of course multiplied by the number of printing times so that the data regarding the multiplication value is used to previously judge whether ink needs to be supplied for the repeated printing.

(2) Layout information is analyzed to calculate, based on the layout of pieces of object information, the area of the margin in a printing medium. Then, this calculated area is compared with a case in which the entire area of the printing medium is applied with a printing agent to print images (full page printing), thereby predicting the amount of the printing agent not to be applied to the printing medium. Then, the not-to-be used amount of printing agent corresponding to the margin is deducted from the usage of the printing agent for the full page printing, thereby assuming the resulting amount as an amount of printing agent required for the printing. Then, the predicted usage of printing agent is compared with an actually-available amount of printing agent (i.e., amount of remaining printing agent that can be supplied) to determine the timing at which the printing agent is supplied.

Some layouts cannot provide an edgeless full page printing to cause a margin region and some layouts specify the tiling of background images for example to require the printing in a region other than the region in which the object information is arranged. Ink usage for such a layout also can be predicted by calculating the area of "region in which no printing is provided=margin region".

(3) When the layout information is analyzed to calculate the area of the margin in the above embodiment of (2), not only the layout of the object information but also the information regarding the specification of the drawing of the background are additionally considered. As a result, ink usage can be predicted in view of the consideration of the ink usage required for drawing the background.

(4) Layout information is analyzed to analyze the contents and layout of a plurality of pieces of object information that are referred by the layout information. As a result, prior to the processing for developing the printing image (to-be-printed image), the usage of printing agent required for printing the object information arranged in accordance with the layout information is predicted. Then, the predicted usage of printing agent is compared with the amount of actually-available printing agent (i.e., amount of printing agent that can be supplied) to determine the timing at which the printing agent is supplied.

When a plurality of pieces of object information are linked and referred, the usage of the printing agent required for printing the plurality of pieces of object information is predicted. Thus, when a plurality of pieces of independent object information are collected and layouts of which are performed based on the page layout, the usage of the printing agent can be predicted. Specifically, the reference to the layout information is always accompanied with the reference and collection of a single or a plurality of pieces of object information. Thus, in such a case, the attribute information of each piece of referred object information is additionally considered to predict the usage of the printing agent.

(5) Layout information is established based on the information describing the document structure (e.g., HTML, XHTML) and the style information for giving an order regarding the layout to such information (e.g., CSS, XSL). Then, the layout information is analyzed to analyze the contents and layout of a plurality of pieces of object information referred by the layout information. As a result, prior to the processing for developing the to-be-printed image, the usage of printing agent required for printing the object information arranged in accordance with the layout information is predicted.

When the layout information is divided into the information describing the document structure (e.g., HTML) and the style information (e.g., CSS), then a Web print or the like has such device-dependent layout information that is described by the style information. Thus, only HTML cannot provide the determination of the print layout. A browser or the like can determine the layout without having CSS description because it has therein a fixed style sheet. Thus, only HTML information without style information cannot provide the generation of the layout information.

(6) Layout information is established based on the information for specifying the number of pieces of object information allocated to one page by DPOF or DPS script for example and based on the style information for giving a layout-related order to the former (e.g., unique template). Then, the layout information is analyzed to analyze the contents and layout of a plurality of pieces of object information referred by the layout information. As a result, prior to the processing for developing the to-be-printed image, the usage of printing agent required for printing the object information arranged in accordance with the layout information is predicted.

In the DPOF specification or the DPS specification or the like, information that specifies how many pieces of photograph object information should be allocated to one printing medium is called layout information. In the case of 2UP layout for example, only layout information does not tell whether or not the two images should be arranged in the longitudinal direction or in the lateral direction, whether or not the two images may be superimposed, or whether or not the two images have the same size, which is not enough for determining the actual layout. With regard to these specifications, a printing apparatus that is directly connected to a laboratory or a digital camera (e.g., PD (Photo Direct) machine) has a layout template corresponding to the 2UP layout. By using the temperate, the machine internally supplement the information required for generating the layout information.

(7) When the layout information is established in the manner as described in the above (5) and (6), the information that specifies the type of a to-be-used printing medium (printing medium type specification information) is also considered. Specifically, when an amount of ink to be used per an unit area is different depending on the type or size of a paper to be used, the paper type specification information for specifying the type of the paper to be used is additionally considered, thereby predicting the ink usage.

In reality, the layout variously changes depending on the information regarding a paper (e.g., A4, postcard, longitudinal placement, lateral placement). Ink usage required for the printing also changes depending on the type of a paper (mat paper, gloss paper, regular paper). In such a case, the paper-type also can be considered to predict the ink usage.

(8) When the layout information is established in the manner as described in the above (5), (6), and (7), the information regarding a limited number of the information regarding the collection of object information that are recorded based on DPOF or other description methods and that are read from a digital image database or the like is also additionally considered.

For example, when five photographs are recorded in a digital camera or a memory card and the layouts of every two of them are done on one page, the layout of only one photograph is done on the final third page. Even in the case of the style information or the layout information that specifies that the layout of two photographs are done on one page, if the number of pieces of object information whose layout is actually done is less than two, then a part having no layout will be a margin. In this case, even in the case of the layout information that specifies that the layout of two photographs are done on one page, only the half of one page will be actually printed, thus increasing the amount of the margin in that page. In such a case, the information regarding the collection of pieces of object information is considered to establish the layout information and the layout information is analyzed. When a PD machine is used to a template process in particular, the number of pieces of object information may have a significant influence on the prediction of the ink usage.

(9) A main body that supplies the layout information and the information regarding one or a plurality of pieces of object information referred by the layout information is not limited to a printing apparatus body and also may be another machine such as a digital camera connected to the printing apparatus body. In this case, another machine such as a digital camera and the printing apparatus constitute a printing system.

A supply source for supplying the object information referred by the layout includes various devices such as a memory card or a digital camera connected to the printing apparatus and there also may be a printing using only a template by the printing apparatus. The layout information may be supplied from any of such supply sources. There is also a case in which a frame image can be downloaded to a digital camera such as a Kodak-made camera, for example. In order to be able to cope with such a case, the present invention also can be used for an application in which the layout information is read from the camera and used.

(10) A media that supplies the layout information and the information regarding one or a plurality of pieces of object information referred by the layout information also may be a recording medium that is detachably connected to the printing apparatus (e.g., memory card). For example, the memory card can supply template information.

(11) A main body that supplies the layout information and the information regarding one or a plurality of pieces of object information referred by the layout information also may be a server in the Internet that is indirectly connected to the printing apparatus via a cell phone or directly connected without such a relay.

(12) The present invention also can be applied to a so-called full-line-type ink jet printing apparatus that uses an ink jet printing head extending for the entire range in the width direction of the printing medium. Furthermore, the present invention can be also applied not only to the ink jet printing apparatus but also to various printing apparatuses for printing an image using various printing agents (e.g., toner).

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2003-417368 filed Dec. 15, 2003, which is hereby incorporated by reference herein.

What is claimed is:

1. A printing apparatus that prints, by applying a printing agent to a printing medium, an image on the basis of data developed from object information, the object information being arranged based on layout information onto the printing medium, the layout information indicating a layout and size of the object information, said apparatus comprising:

calculation means for analyzing the layout information to calculate a printing area in which the image is to be printed, said calculation means calculating the printing area based on the layout and size of the object information indicated by the layout information without using the data developed from the object information; and prediction means for predicting, based on the printing area calculated by said calculation means, the usage of the printing agent required for printing the image, wherein said calculation means calculates the printing area in which a plurality of pieces of object information are arranged based on the layout information, and said prediction means predicts, based on the printing area calculated by said calculation means, the usage of the printing agent required for printing the printing area in which the plurality of pieces of the object information are arranged.

2. A printing apparatus according to claim 1, wherein said calculation means also analyzes the information regarding the drawing of a background to calculate the printing area when the object information and the background are printed on a unit area of the printing medium, and said prediction means predicts, based on the printing area calculated by said calculation means, the usage of the printing agent required for printing the object information and the background.

3. A printing apparatus according to claim 1, further comprising judgment means for comparing the usage of the printing agent predicted by said prediction means with an amount of the remaining printing agent in a printing agent supply source for supplying the printing agent to judge whether or not the printing agent needs to be supplied to the printing agent supply source.

4. A printing apparatus according to claim 3, further comprising supply means for supplying, when said judgment means judges that the printing agent needs to be supplied, the printing agent to the printing agent supply source.

5. A printing apparatus according to claim 1, wherein the printing agent is ink that can be ejected from an ink jet printing head.

6. A printing apparatus according to claim 1, further comprising establishment means for establishing the layout information based on document structure description information and style information providing information regarding a layout, wherein said calculation means calculates the area based on the layout information established by said establishment means.

7. A printing apparatus according to claim 6, wherein said establishment means establishes the layout information in accordance with the information regarding a type of the printing medium that has an influence on the usage of the printing agent.

8. A printing apparatus according to claim 6, wherein said establishment means establishes the layout information in accordance with the information that relates to a collection of the plurality of object information allocated to a printing medium and that has an influence on the usage of the printing agent.

9. A printing apparatus according to claim 1, further comprising establishment means for establishing the layout information based on allocation information that specifies the number of the object information allocated in a predetermined region of the printing medium and a predetermined layout template that specifies a layout, wherein said calculation means calculates the area based on the layout information established by said establishment means.

10. A printing apparatus according to claim 1, further comprising reading means that can read, from a storage medium for storing the information regarding the layout information and the object information, the information regarding layout information and the object information.

11. A printing system, comprising:

a printing apparatus according to any one of claims 1, 2 and 3 to 8; and an information provision apparatus for providing the information regarding the layout information and the object information.

12. A printing system according to claim 11, wherein said information provision apparatus provides, via the Internet, the information regarding the layout information and the object information.

13. A method for predicting the usage of a printing agent in a printing apparatus that prints, by applying the printing agent to a printing medium, an image on the basis of data developed from object information, the object information being arranged based on layout information onto the printing medium, the layout information indicating a layout and size of the object information, the method comprising:

a calculating step of analyzing the layout information prior to a processing for developing a printing image to calculate a printing area in which the image is to be printed, said calculating step calculating the printing area based on the layout and size of the object information indicated by the layout information without using the data developed from the object information; and a predicting step of predicting, based on the calculated printing area, the usage of the printing agent required for printing the image, wherein said calculating step calculates the printing area in which a plurality of pieces of object information are arranged based on the layout information, and said predicting step predicts, based on the printing area calculated in said calculating step, the usage of the printing agent required for printing the printing area in which the plurality of pieces of the object information are arranged.

14. A method for predicting the usage of a printing agent according to claim 13, further comprising a judging step of comparing the usage of the printing agent predicted by said predicting step with an amount of the remaining printing agent in a printing agent supply source for supplying the printing agent to judge whether or not the printing agent needs to be supplied to the printing agent supply source.

* * * * *